United States Patent [19]

Matsumoto et al.

[11] 3,989,396

[45] Nov. 2, 1976

[54] STEEL BOX-COLUMN FOR STEEL STRUCTURES

[75] Inventors: Tsutomu Matsumoto, Mitaka; Asao Yamamoto, Musashino, both of Japan

[73] Assignee: Nippon Steel Corporation, Tokyo, Japan

[22] Filed: Oct. 28, 1975

[21] Appl. No.: 626,447

Related U.S. Application Data

[63] Continuation of Ser. No. 257,657, May 30, 1972, abandoned.

[52] U.S. Cl. ..... 403/174; 52/721; 52/731; 403/173; 403/271

[51] Int. Cl.[2] ..... E04C 3/32

[58] Field of Search ..... 52/721, 731, 283; 403/173, 174, 217, 271, 272

[56] References Cited

UNITED STATES PATENTS

| | | | |
|---|---|---|---|
| 1,844,498 | 2/1932 | Candy | 403/217 |
| 2,574,241 | 11/1951 | Bobst | 52/731 X |
| 3,050,161 | 8/1962 | Shlager | 52/731 X |
| 3,293,822 | 12/1966 | Neuhoff et al. | 29/155 R |
| 3,694,990 | 10/1972 | Pamer | 52/731 |

FOREIGN PATENTS OR APPLICATIONS

| | | | |
|---|---|---|---|
| 197,263 | 7/1965 | Sweden | 52/731 |
| 942,233 | 11/1963 | United Kingdom | 52/731 |

*Primary Examiner*—Alfred C. Perham
*Attorney, Agent, or Firm*—Wenderoth, Lind & Ponack

[57] ABSTRACT

A steel box-column for steel structures comprises a pair of steel channel members each having beam-column connecting diaphragms set inside thereof at respective positions whereat flanges of beams are welded to the exterior of the channel members. The flanges and the web of each steel channel member are welded to three sides of each of the connection diaphragms. A pair of the steel channel members are welded to each other at ends of their flanges facing each other.

4 Claims, 7 Drawing Figures

STEEL BOX-COLUMN FOR STEEL STRUCTURES

This is a continuation of application Ser. No. 257,657, filed May 30, 1972, now abandoned.

BACKGROUND OF THE INVENTION

1. Field of the Invention

The present invention relates to a steel box-column for steel structures, and more particularly to a steel box-column consisting of a pair of steel channel members, each having beam-column connection diaphragms set inside thereof.

2. Description of the Prior Art

The steel box-column is excellent in section moduli, compared with H-shaped steel and round steel pipes, and its use makes connection details simple.

The conventional methods for producing steel box-columns are: (1) assembly with four steel plates; (2) folding a single sheet of steel into a four-sided box column and welding the two ends; (3) pressing a round steel pipe into a square form; and (4) welding of a pair of right angle steel members. However, it is difficult to set beam-column connection diaphragms inside such conventionally produced box-columns, and therefore, production of such kinds of box-columns requires complicated additional steps such as the so-called "passing through-diaphragm type box-column" in which the diaphragms pass through the box-column transversely and the so-called "outside diaphragm type box-column" in which diaphragms are set around the box-column.

Accordingly, steel box-columns having beam-column connection diaphragms according to the conventional methods, require many steps to produce the finished product, have poor aesthetic quality, and have complicated stress distributions, thus causing the finished product to be unsuitable for manufacture on an industrial scale.

SUMMARY OF THE INVENTION

The present invention obviates the above described problems by providing a steel box-column consisting of a pair of steel channel members each having beam-column connection diaphragms set inside thereof.

This invention contemplates a steel box-column for steel structures which is characterized by the provision of steel channel members consisting of a pair of steel channel members each having beam-column connection diaphragms set inside thereof at respective positions whereat flanges of beams are exteriorly welded. The flanges and the web of the steel channel members is welded to three sides of each of the connection diaphragms. A pair of such steel channel members are welded to each other at ends of their flanges facing each other.

Accordingly, an object of the present invention is to provide a steel box-column for steel structures which is made through a simple production process.

Another object of the invention is to provide a steel box-column for steel structures which is strong and which also exhibits a pleasing appearance.

These and other objects of the present invention will be more clearly understood when the following description of preferred embodiments is taken in conjunction with the accompanying drawings.

DESCRIPTION OF THE PREFERRED EMBODIMENTS

Figure 1:
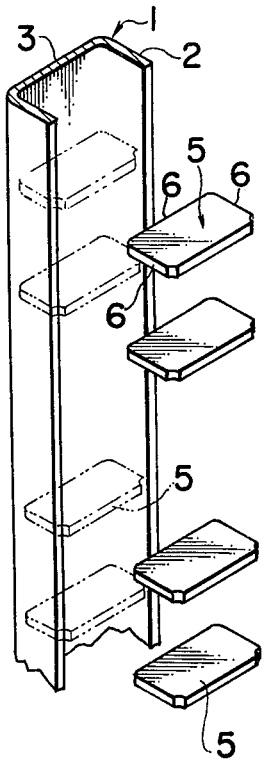
FIGS. 1 to 3 are perspective views illustrating the fabrication of a steel box-column of an embodiment of the present invention.
Figure 2:
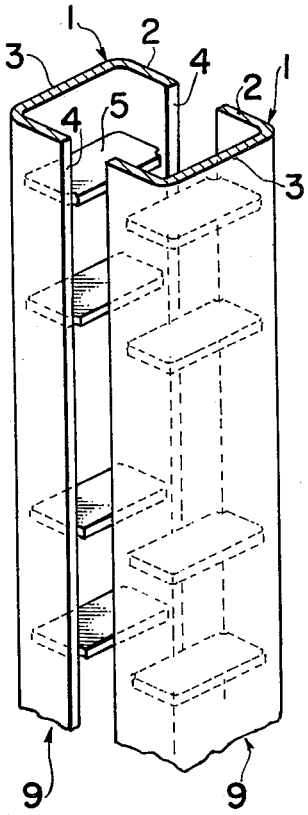
Figure 3:
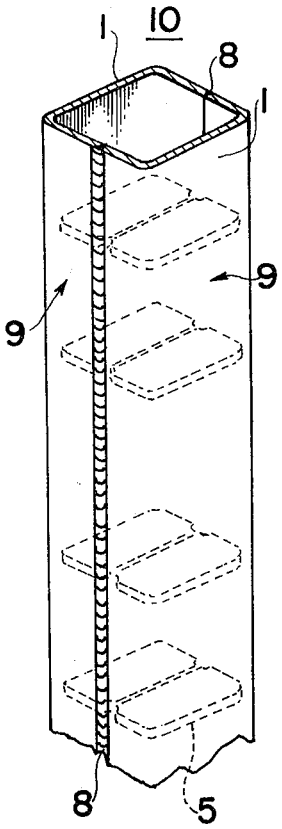
Figure 4:
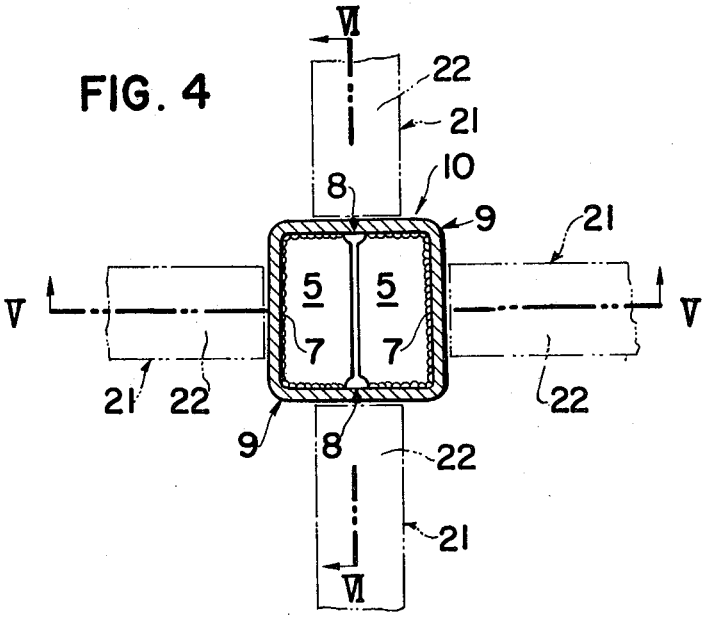
FIG. 4 is a view in horizontal section through the box-column shown in FIG. 3.
Figure 5:
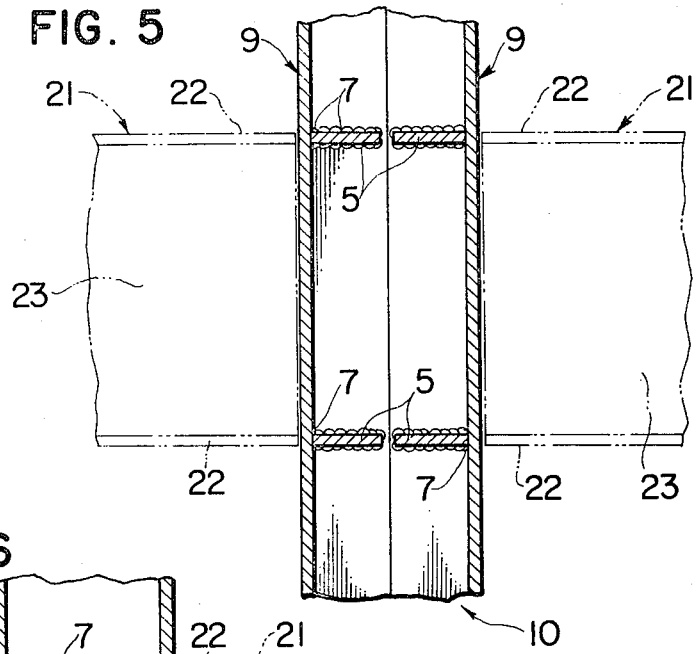
FIG. 5 is a view in vertical section taken along line V—V of FIG. 4.
Figure 6:
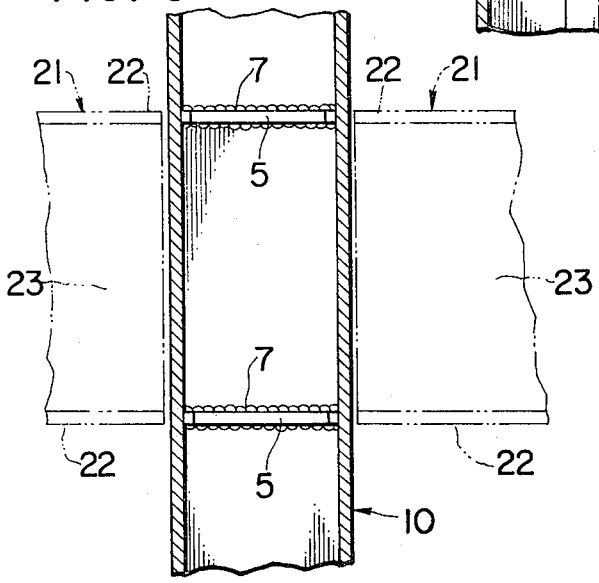
FIG. 6 is a view in vertical section taken along line VI—VI of FIG. 4.

With reference now to the drawings, the steel box-column of the present invention will be described.

FIGS. 1 to 6 show an embodiment of the present invention, in which a plurality of connection diaphragms 5 made of steel are set inside a steel channel member 1 having flanges 2 of equal width, at positions corresponding to those whereat flanges 22 of beams 21 are exteriorly welded. Each connection diaphragm 5 is, in general, a piece of rectangular plate having a thickness equal to or slightly greater than that of the corresponding flanges 22 of the beams 21 welded to the exterior of the box-column 10. The flanges 2 and the web 3 of steel channel member 1 are connected by welding 7 to each of the diaphragms 5 along the three contacting sides 6 thereof, so as to form a steel channel member 9 having beam-column connection diaphragms set inside thereof. A pair of the so formed steel channel members 9 having connection diaphragms set inside thereof are connected by welding 8 at the ends 4 of flanges 2 which face each other, with their corresponding connection diaphragms 5 also facing each other, so as to form a steel box-column 10 having beam-column connection diaphragms set inside thereof as shown in FIG. 3 to FIG. 6.

Figure 7:
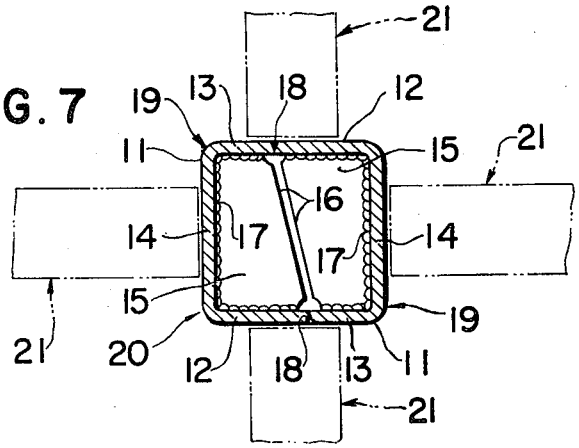
FIG. 7 is a view similar to FIG. 4, but of a steel box-column of another embodiment of the present invention.

FIG. 7 shows another embodiment of the present invention, in which a connection diaphragm 15, which is made of steel but which has a diagonal side 16, at a position whereat the flange of a beam is exteriorly welded, is set inside a steel channel member 11 having one long flange 12 and one short flange 13. The long flange 12, the short flange 13 and the web 14 of steel channel member 11 are connected by welding 17 to a plurality of connection diaphragms 15 so as to form a steel channel member 19 having connection diaphragms set inside thereof. The connection diaphragms 15 and the long flange 12 and the short flange 13 of the so formed steel channel members 19 having connection diaphragms set inside thereof are placed face-to-face, so that the long flange 12 of one member is connected by welding 18 with the short flange 13 of the other member, and vice versa, with their corresponding connection diaphragms facing each other, thus forming a steel box-column 20 having beam-column connection diaphragms set inside thereof.

In the case of the embodiment of FIG. 7, the welding line of the steel box-column 20 with the web 23 of the beam 21 does not coincide with the welding line 18 of the facing long and short flanges 12 and 13 of the facing steel channel members. Therefore, undesirable overlapping of these welding lines is avoided.

According to the present invention, it is possible to distribute forces which come from flanges 22 of beam 21 welded on one side of the steel box-column 10 or 20 to adjoining flanges welded on the same box-column through the connection diaphragms 5 or 15. In case a load is put on the beam 21 welded on the web 3 of the steel channel member 1 of the steel box-column 10, such load will be distributed to both flanges 2 through the connection diaphragm 5. Therefore, stress can be surely transmitted, even though the connection diaphragms 5 or 15 are not connected at the free sides thereof to the opposite connection diaphragms. The rigidity of the connection according to the present invention is slightly less than that of one-piece-diaphragms used by the conventional methods because of the division into two pieces according to the present invention. However, the lowering of rigidity can be offset by making the diaphragms thicker.

Also, the production process of forming the steel box-column is so simple as mentioned above that the number of steps in the production of steel box-columns according to the present invention is about two thirds of the number of steps required in conventional methods.

Thus, it is possible to obtain strong box-columns having satisfactory exterior appearance at lower cost according to the present invention.

What is claimed is:

1. A stress transmitting steel structure comprising:

a rectangular steel box-column comprising:

a pair of steel channel members each having a web portion and two flanges, one flange depending from each edge of said web portion;

a plurality of substantially rectangular beam column connection diaphragms positioned within each of said steel channel members, each said connection diaphragm being welded along three edges thereof to the respective steel channel member, with two opposite edges welded to said flanges of said respective steel channel member, and an edge between said two opposite edges welded to said web portion of said respective steel channel member; and said pair of steel channel members being aligned with said flanges thereof facing each other and with each of said connection diaphragms of one steel channel member facing a corresponding connection diaphragm of the other steel channel member, said steel channel members being welded together at the ends of their adjacently positioned flanges; and plural beams, each said beam having a web with flanges at opposite edges thereof, each said beam having an end thereof welded to an exterior face of said rectangular steel box-column, with each said beam flange aligned with one of said connection diaphragms.

2. A structure as claimed in claim 1, wherein said two flanges of each said steel channel member comprise a long flange and a short flange, said pair of steel channel members being aligned with said long flange of one steel channel member welded to said short flange of the other steel channel member, and vice versa.

3. A structure as claimed in claim 2, wherein each said connection diaphragm has a diagonal edge facing said corresponding connection diaphragm.

4. A structure as claimed in claim 1, wherein the adjacently facing connection diaphragms of said steel channel members face each other with respective edges which are not connected.

* * * * *